United States Patent [19]

Rende

[11] Patent Number: 4,765,510

[45] Date of Patent: Aug. 23, 1988

[54] MULTIPLE COLOR FLUID DISPENSING GUN

[76] Inventor: Vincent N. Rende, 42 Water St., Eastchester, N.Y. 10790

[21] Appl. No.: 35,184

[22] Filed: Apr. 7, 1987

[51] Int. Cl.[4] ..... A63H 3/18; B67D 5/52

[52] U.S. Cl. ..... 222/79; 222/39; 222/137; 222/255; 222/379; 239/306; 239/331; 239/422; 239/423; 239/526

[58] Field of Search ..... 222/79, 137, 132, 135, 222/330, 331, 39, 255, 265, 320, 372, 379, 382–385; 239/331, 333, 335, 304, 306, 526, 420, 422, 423; 272/27 N; 273/349

[56] References Cited

U.S. PATENT DOCUMENTS

| | | | |
|---|---|---|---|
| Re. 24,208 | 9/1956 | Steiner | 222/79 X |
| D. 159,040 | 6/1950 | Bicos | 222/79 X |
| D. 168,314 | 12/1952 | McLain | 222/79 X |
| 1,979,014 | 10/1934 | Schleif | 222/79 |
| 2,136,024 | 11/1938 | Schneider | 239/306 X |
| 2,606,072 | 8/1952 | Mantle | 239/306 X |
| 2,753,079 | 7/1956 | Hersey | 222/79 |
| 2,941,696 | 6/1960 | Homm | 239/306 X |
| 3,045,925 | 7/1962 | Giangualano | 239/306 |
| 3,117,696 | 1/1964 | Herman et al. | 222/137 |
| 3,135,467 | 6/1964 | Greenman | 239/304 |
| 3,178,118 | 4/1965 | New | 239/422 |
| 3,269,389 | 8/1966 | Meurer et al. | 239/304 X |
| 3,310,204 | 3/1967 | Zinman et al. | 222/144.5 |
| 3,365,838 | 1/1968 | Butler et al. | 222/79 X |
| 3,415,420 | 12/1968 | White | 222/79 |
| 3,760,986 | 9/1973 | Castner et al. | 222/137 |
| 4,591,071 | 5/1986 | Johnson | 222/79 X |
| 4,597,527 | 7/1986 | Sands | 239/394 |

*Primary Examiner*—Kevin P. Shaver
*Attorney, Agent, or Firm*—Walter C. Farley

[57] ABSTRACT

A fluid gun has multiple spring-loaded oblong extendable barrels arranged to provide a plurality of fluid streams which intersect in air at a predetermined distance from the nozzles when a single trigger is squeezed. The gun has separate chambers containing fluids of different colors. When the streams intersect, the colors combine and mix.

6 Claims, 2 Drawing Sheets

MULTIPLE COLOR FLUID DISPENSING GUN

This invention relates to a fluid dispensing apparatus capable of holding and dispensing fluids of different colors and is particularly useful as a toy in which the differently colored fluids are dispensed in streams which converge in mid-air, allowing the fluids to interact and colors to mix and blend.

BACKGROUND OF THE INVENTION

Fluid discharging guns containing multiple chambers are known as evidenced by U.S. Pat. No. 3,399,485, Cashavelly, and constructing a water pistol or the like so that the stream can be dispensed in various directions is shown in U.S. Pat. No. 4,597,527, Sands, in which the nozzle has a number of differently directed apertures, any one of which can be active. Other fluid dispensing devices are shown by Schleif, U.S. Pat. No. 1,979,014 and New, 3,178,118. A design for a water gun apparently having multiple chambers is shown in Bicos, design Pat. No. 159,040.

The above patents illustrate that very little change or development has taken place in this area for many years.

SUMMARY OF THE INVENTION

An object of the present invention is to provide a novel hand held fluid gun capable of dispensing fluids in streams of different colors and arranging the nozzles so that the streams merge and collide to produce unique visual effects.

A further object is to provide such an apparatus which is simple to manufacture. A still further object is to provide such a water gun in which other sound and motion characteristics can be incorporated to provide an appealing toy.

Briefly described, the invention comprises a fluid dispensing apparatus including a housing having a manually graspable handle, a plurality of fluid-containing chambers in the housing, the chambers containing fluids having different characteristics, and a plurality of laterally spaced nozzles mounted in the housing and pointing in the same general direction as each other. The nozzles are oriented so that their central axes intersect at a point which is a predetermined distance from the housing. Fluid conduit means are provided to interconnect the chambers and nozzles, respectively, for delivering fluid from the chambers to the nozzles for dispensing. A manually movable trigger is mounted adjacent the handle, the trigger operating means for concurrently applying pressure to the fluid in all of the chambers in response to movement of the trigger to force fluid under pressure from the chambers, through the conduits and out of the nozzles, thereby forming a plurality of fluid streams which intersect at the defined point allowing the fluids to interact.

BRIEF DESCRIPTION OF THE DRAWINGS

In order to impart full understanding of the manner in which these and other objects are attained in accordance with the invention, a particularly advantageous embodiment thereof will be described with reference to the accompanying drawings, which form a part of this specification, and wherein.

DESCRIPTION OF THE PREFERRED EMBODIMENT

As mentioned above, the invention is applicable to dispensing fluids having different colors or characteristics other than colors, the characteristics being such that combining the fluids causes a chemical or physical interaction and a change in the resulting blend. However, for simplicity the apparatus will be discussed in the context of colors only.

Figure 1:
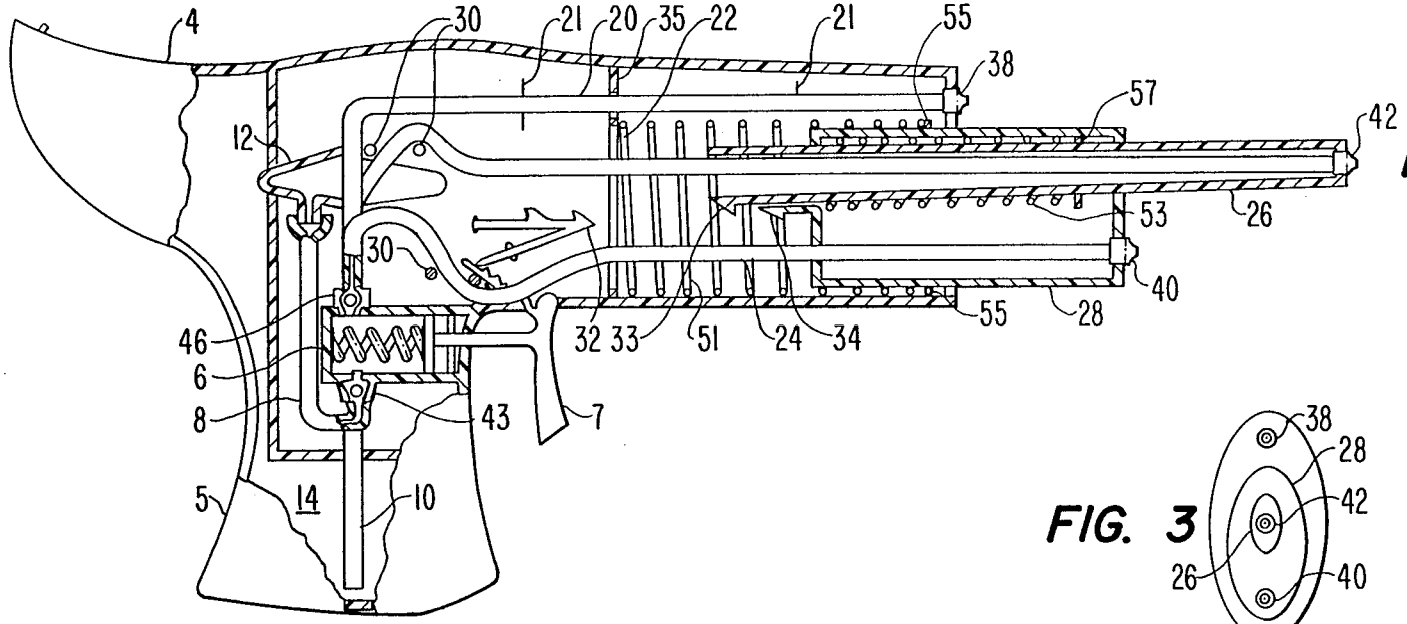
FIG. 1 is a side elevation, in section, of a water gun in accordance with the invention.
Figure 3:
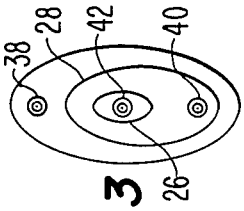
FIG. 3 is a front end elevation of the water gun of FIGS. 1 and 2.
Figure 2:
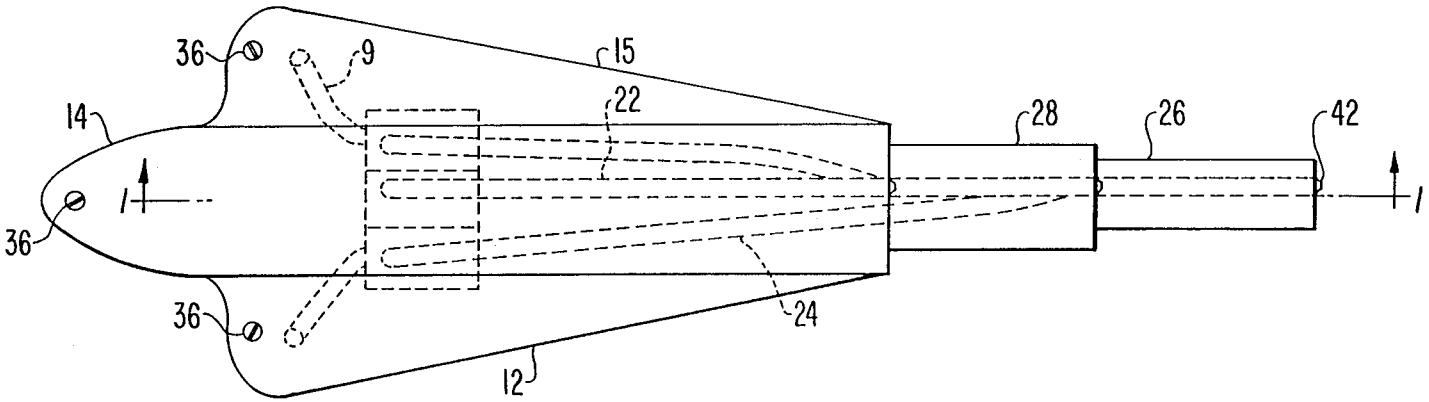
Fig. 2 is a top plan view of the water gun of FIG. 1.

Referring first to FIGS. 1–3, it will be seen that the fluid gun of the illustrated embodiment includes a housing 4 which is formed with a manually graspable handle 5 and contains a ganged plunger or piston assembly 6. The plunger or piston assembly is formed with three portions, each having a cylinder portion and a plunger portion, the plungers being interconnected with each other and with a trigger 7, as will be described, so that they are operated together. Each cylinder portion is connected to one end of an input hollow tube 8, 9 or 10, tubes 8 and 10 being visible in FIG. 1 and 9 in FIG. 2, the other ends of the tubes being connected to different portions of the housing. The interior of the housing is separated into three independent chambers 12, 14 and 15, each chamber being capable of holding a fluid. The chambers are independent so that they can contain a fluid such as water having a color (or other characteristic) different from the fluids in the other chambers and can keep those colors isolated from each other so long as they are within the housing. Thus, tube 10 extends to chamber 14 within handle 5 which can contain, for example, a yellow fluid; tube 8 extends to chamber 12 which can contain a blue fluid, for example; and tube 9 extends to chamber 15 which can contain a red fluid.

Additional hollow output tubes 20, 22 and 24 are connected to the cylinders and extend to nozzles 38, 40 and 42 at the forward end of the housing. Each of the input tubes 8, 9 and 10 is provided with a check valve 43 to permit fluid flow only toward its associated cylinder while each of the output tubes is provided with a check valve 46 to permit fluid flow only out of the cylinder. The output tubes 22 and 24 are necessarily flexible to allow longitudinal movement of barrel cylinders, as will be described. Tube 20 is, however, supported by protruding tabs 21 which can be mounted on the interior of the housing and by a transverse internal wall 35.

Tubes 22 and 24 are supported on guide posts 30, also formed on the interior of the housing in such a way that the tubes can bend or fold without restricting fluid flow.

At the forward end of the housing are movable barrels 26 and 28 which are slidably received in the end of the housing. Barrel 28 is slidable relative to the main portion of the housing 4 and barrel 26 is slidably mounted in barrel 28 to be movable relative to barrel 28 as well as to the housing. The inner ends of barrels 26 and 28 are provided with plastic teeth 33 and 34, respectively, which can engage teeth 44 and 45 on a latch member 32, mounted within the housing above the trigger mechanism, to hold the barrels in their retracted positions.

As seen in FIG. 2, the housing is provided with removable plugs 36 which allow the chambers 12, 14 and 15 to be independently filled with fluids of the desired colors.

Figure 4:
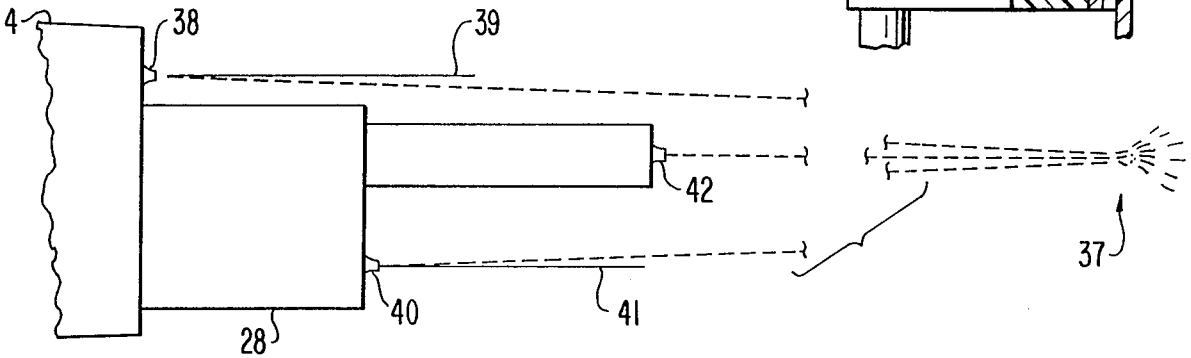
FIG. 4 is a fragmentary side elevation of nozzle portions of the water gun of FIGS. 1–3 showing the angular relationship of the axes of the nozzles.

As seen in FIG. 3, nozzles 38, 40 and 42 lie in essentially the same vertical plane with each other but are laterally offset, i.e., they are above one another. Additionally, as seen in FIG. 4, nozzle 42 is directed so that it projects a stream along the central axis of the housing but nozzles 38 and 40 are tilted or skewed relative to lines 39 and 41 which are parallel with the central axis so that the projection axes of the nozzles themselves intersect with the axis of nozzle 42 at a point 37 which is at some predetermined distance from the gun. This distance can vary with the size of the overall device and the strength of the trigger mechanism. For a small pistol-sized gun of the type illustrated, a distance of about 6 feet from the nozzle is considered suitable. The nozzle relationship illustrated is that which exists when the barrels are in their extended positions.

Each of the barrels 26 and 28 is provided with a compression coil spring to urge the barrel toward its extended position. As illustrated in FIG. 1, barrel 28 is in its nearly extended position with its compression spring 51 elongated. Barrel 26 is also in a partially retracted position relative to barrel 28 with compression spring 5 still partly compressed. Spring 53 acts against a flange 57 formed on the exterior of barrel 26 and spring 51 acts between wall 35 and a similar flange 55 on barrel 28.

Figure 5:
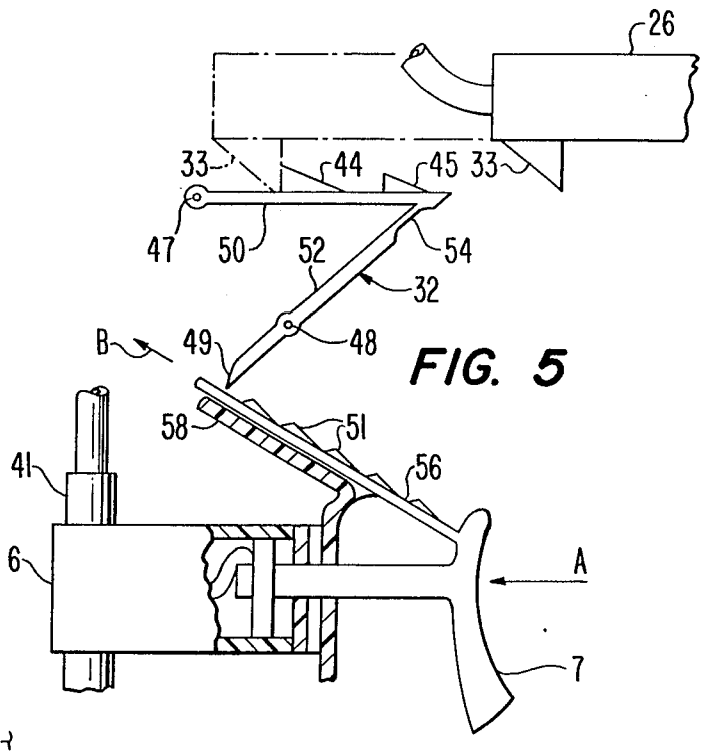
FIG. 5 is a side elevation, partly in section, of portions of the apparatus of the water gun of FIGS. 1–3 removed from the housing.

In order to lock the barrels in their retracted positions, barrels 26 and 28 are manually pressed in the direction toward latch member 32, to the left in FIG. 1. FIG. 5 shows this portion of the structure in somewhat greater detail. Only barrel 26 is shown therein, but the action with respect to barrel 28 is substantially identical. When barrel 26 is pushed to the left to the position generally indicated in dot-dash lines in FIG. 5, tooth 33 engages a tooth 44 on a generally horizontal bar 50 forming a part of latch structure 32. Tooth 34 on barrel 28 can similarly engage a tooth 45 on bar 50. The barrels are thus latched in their retracted positions against the force of springs 51 and 53.

Bar 50 of latch member 32 is pivotably supported on a pivot pin 47 which is attached to housing 4. A diagonally extending lever 52 is pivotably mounted on a pivot pin 48, an end of lever 52 being connected to bar 50 by a thinned, flexible portion 54. The distal end of bar 52 is tapered to nearly a point and is on the opposite side of pin 48 from the thinned portion.

The release for the latch mechanism is actuated by movement of trigger 7. An elongated ratchet member 56 is flexibly connected to the upper portion of trigger 7 and extends diagonally into housing 4. The housing is provided with an inclined, substantially rigid guide surface 58 which is generally parallel with ratchet member 56. The upper surface of the ratchet member is provided with a plurality of tooth-like protrusions 51.

When the trigger 7 is depressed in the direction of arrow A, ratchet member 56 with its protrusions 51 moves in the same general direction as arrow B, causing the protrusions to successively engage the end 49 of bar 52. Bar 52 is thereby caused to rotate in a clockwise direction, as seen in FIG. 5, by each of the protrusions. Since bar 52 is connected to bar 50 by the flexible portion 54, the unconnected end of bar 50 is caused to move downwardly, pivoting the bar clockwise about its pivot pin 47, thereby moving teeth 44 and 45 downwardly and releasing teeth 33 and 34. The barrels are then quickly urged to their extended positions by the action of springs 50 and 52.

This motion has the additional effect of creating a sound as the end 49 of bar 52 is caused to snap past each of the protrusions 51 on ratchet member 56. This sound is generated each time the trigger is depressed, whether or not the latch-releasing action has already taken place.

Figure 6:
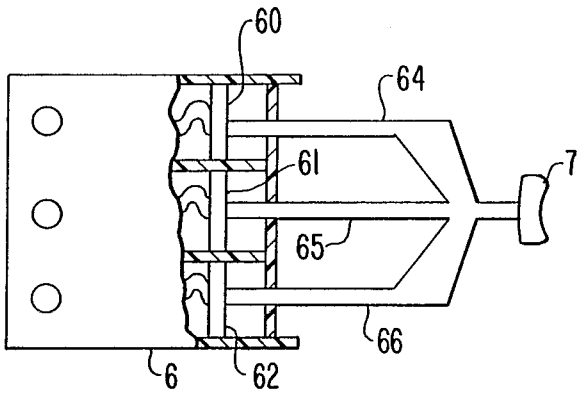
FIG. 6 is a top plan view of the trigger and piston arrangement.

FIG. 6 shows the piston and cylinder arrangement with the trigger mechanism in a schematic plan view, apart from the remainder of the apparatus. As seen therein, the cylinder assembly comprises a housing having three parallel cylinders therein, the cylinders containing pistons 60, 61 and 62. Trigger 7 is fixedly attached to three separate arms 64, 65 and 66, each arm being connected to one of the pistons. Thus, when the trigger is depressed, all three pistons are concurrently moved into their respective cylinders, placing any fluid therein under pressure. Each cylinder also contains a compression coil spring to return the pistons and the trigger assembly to its original position. Openings at the top of each piston and at the bottom thereof are provided for check valves 41 and 43, as previously described.

As the trigger is returned to its initial position by the spring action, liquid is drawn into the three cylinders through tubes 8, 9 and 10 from their respective chambers. When the trigger is depressed, the fluid is ejected through outlet tubes 20, 22 and 24 and thus to nozzles 38, 42 and 40, respectively, causing streams of the fluid to be ejected from those nozzles, the streams intersecting at location 37 as previously described.

Assuming that barrels 26 and 28 were initially pushed into their latched positions, the first depression causes the barrels to be released and to spring to their extended positions. A noise is generated, as described, by this and each subsequent depression of the trigger. The fluid streams are then ejected whenever the trigger is depressed, causing the three streams to be simultaneously ejected and to intersect at the described location where the fluids can interact.

The apparatus of the invention has been described in terms of the blending or mixing or colored streams of liquid. It is contemplated, however, that other forms of interaction can be employed. It can be, for example, that fluids with which do not initially appear to have any color alone will produce a color when mixed with fluids from the other chambers and streams. Other forms of interaction are also possible.

While one advantageous embodiment has been chosen to illustrate the invention, it will be understood by those skilled in the art that various changes and modifications can be made therein as defined in the appended claims.

What I claim is:

1. A fluid dispensing apparatus comprising a housing having a manually grasping handle;

a manually movable trigger mounted adjacent said handle;

means defining a plurality of fluid-containing chambers in said housing each of said chambers containing a fluid having a characteristic different from the characteristics of the fluids in the other chambers;

a plurality of laterally spaced nozzles mounted in said housing and pointing in the same general direction, said nozzles being oriented so that the central axes thereof intersect at a point which is a predetermined distance from said housing;

a plurality of barrels, equal in number to the number of nozzles, slidably mounted in said housing for movement between retracted and extended positions, each of said barrels having one of said nozzles mounted at an end thereof;

spring means urging each of said barrels toward its extended position; and releasable latch means for holding said barrels in their retracted positions, said latch means being released by manual movement of said trigger;

fluid conduit means interconnecting each of said chambers with one of said nozzles for delivering fluid from said chambers to said nozzles, respectively;

means for concurrently applying pressure to the fluid in all of said fluid conduit means in response to movement of said trigger to force fluid under pressure from said chambers through said conduit means and out of said nozzles, thereby forming a plurality of fluid streams which intersect at said point so that said fluids can interact.

2. An apparatus according to claim 1 wherein said means for applying pressure includes a plurality of cylinders, equal in number to the number of nozzles;

a piston in each of said cylinders; and means mechanically connecting said trigger to each of said pistons so that movement of said trigger moves said pistons together.

3. An apparatus according to claim 2 wherein said fluid conduit means includes a plurality of input conduits, each said input conduit interconnecting one of said fluid-containing chambers with one of said cylinders, each said input conduit including a check valve therein for permitting fluid flow only in the direction from its associated chamber toward its associated cylinder; and a plurality of output conduits, each said output conduit interconnecting one of said cylinders with one of said nozzles, each said output conduit including a check valve therein for permitting fluid flow only in the direction from its associated cylinder toward its associated nozzle.

4. An apparatus according to claim 1 wherein said latch means comprises a latch bar pivotally mounted in said housing;

a plurality of latch teeth attached to said latch bar;

a barrel latch tooth on each of said barrels, each said barrel latch tooth being in position to engage a latch tooth on said bar when its associated barrel is in its retracted position;

a lever pivotally mounted between its ends in said housing, one end of said lever being attached to said latch bar;

an actuating member attached to and movable with said trigger, said actuating member being engageable with the other end of said lever to pivot said lever and said latch bar in a direction to disengage said latch teeth from said barrel latch teeth so that said barrels are moved by said spring means to their extended positions.

5. An apparatus according to claim 4 wherein said actuating member includes a generally flat member flexibly connected to said trigger; and a plurality of ratchet teeth on a surface of said flat member facing said lever, said ratchet teeth being successively moved past said other end of said lever as said trigger is depressed, whereby a noise is generated when said ratchet teeth are successively moved past said other end of said lever.

6. An apparatus according to claim 5 wherein said housing further includes guide means formed thereon for guiding said flat member along said other end of said lever.

* * * * *